United States Patent [19]

Nakamatsu et al.

[11] Patent Number: 4,589,959

[45] Date of Patent: May 20, 1986

[54] PROCESS FOR ELECTROLYTIC TREATMENT OF METAL BY LIQUID POWER FEEDING

[75] Inventors: Syuji Nakamatsu, Kanagawa; Takayuki Shimamune, Tokyo, both of Japan

[73] Assignee: Permelec Electrode Ltd., Kanagawa, Japan

[21] Appl. No.: 680,728

[22] Filed: Dec. 12, 1984

[30] Foreign Application Priority Data

Dec. 27, 1983 [JP] Japan ..... 58-244661

[51] Int. Cl.[4] ..... C25D 7/00

[52] U.S. Cl. ..... 204/28; 204/58; 204/290 R; 204/290 F; 204/291

[58] Field of Search ..... 204/129, 28, 58, 290 F, 204/290 R, 291

[56] References Cited

U.S. PATENT DOCUMENTS

| | | | |
|---|---|---|---|
| 1,266,557 | 5/1918 | Coulson | 204/58 |
| 1,916,586 | 7/1983 | Robinson et al. | 204/58 |
| 2,541,275 | 2/1951 | Odier | 204/28 |
| 3,359,190 | 12/1967 | Cooke et al. | 204/28 |
| 3,920,525 | 11/1975 | Fromson | 204/28 |
| 3,989,605 | 11/1976 | Yanagida et al. | 204/28 |
| 4,113,579 | 9/1978 | Randall, Jr. et al. | 204/42 |
| 4,406,757 | 9/1983 | Huang | 204/290 F |
| 4,437,946 | 3/1984 | Bernard | 204/42 |
| 4,457,824 | 7/1984 | Dempsey et al. | 204/290 F |
| 4,481,084 | 11/1984 | Chen et al. | 204/28 |

FOREIGN PATENT DOCUMENTS

| | | | |
|---|---|---|---|
| 2844558 | 5/1979 | Fed. Rep. of Germany | 204/291 |

*Primary Examiner*—R. L. Andrews

*Attorney, Agent, or Firm*—Sughrue, Mion, Zinn, Macpeak & Seas

[57] ABSTRACT

A process for electrolytic treatment of a metallic object by the liquid power feeding method comprising an electrolyte containing an organic acid or a salt thereof, an electrode comprising a substrate of corrosion-resistant metal and an electrode coating based on the presence of at least some iridium oxide and formed on the substrate, where such functions advantageously as a stable anode enjoying long service life.

1 Claim, No Drawings

PROCESS FOR ELECTROLYTIC TREATMENT OF METAL BY LIQUID POWER FEEDING

FIELD OF THE INVENTION

This invention relates to a process for the electrolytic treatment of a metal with an electrolyte containing an organic acid or a salt thereof by the liquid power feeding method.

BACKGROUND OF THE INVENTION

It is widely known to effect surface treatments such as formation of oxide coatings and electrolytic etching on metals such as aluminum by subjecting such metals to electrolysis. These surface treatments are carried out by methods which can be broadly classified as batchwise or continuous. Treatments of the latter type are capable of mass production and, therefore, are adopted for electrolytic treatment of various metallic articles such as building materials and electrolytic capacitors.

In the continuous electrolytic treatment of a thin metallic sheet, for example, it has been customary to feed power directly to the metallic sheet being treated by means of metallic contact roll. Recently a method for the electrolytic treatment of metallic objects by a liquid power feeding instead of the power feeding by direct contact has been proposed.

The term "liquid power feeding" as used herein means a method for indirectly feeding power through the medium of the electrolyte. Since this method does not require direct electric contact at any point on the object under treatment, it is sometimes alternatively called a "non-contact electrifying method". This method is described in detail, for example, in "Working Surface Technique", Vol. 29, No. 10, pp. 17–21 (1982). Electrolytic treatment by the liquid power feeding method is particularly suitable for continuous high-speed treatment of a thin sheet or foil of metal. The feasibility of this particular method of electrolysis in the commercial production of electrolytic capacitors of Al and Ta, for example, is presently underway. In the process of electrolytic treatment using this liquid power feeding method, the treatment for desired formation is obtained by feeding power to an anode disposed in an anodic power feeding compartment and to a cathode disposed in a forming compartment and continuously passing a metallic foil under treatment in an electrolyte which fills both compartments. The metallic foil is polarized between the two compartments and is subjected to electrolytic oxidation while functioning as a cathode within the anodic power feeding compartment and as an anode within the forming compartment. Electrolytic treatment by the liquid power feeding method, therefore, necessitates additional use of an insoluble anode capable of withstanding use in the electrolyte.

As the electrolyte, a solution of an ammonium salt of an inorganic acid such as boric acid or phosphoric acid has been used. Recently, a solution containing an ammonium salt of an organic acid has been demonstrated to yield more desirable results (as described in the "Handbook on Metal Surface Techniques", page 677 (1976) published by Japan Industry News and in Japanese patent application Laid Open No. SHO 56(1981)-140618). So far, no anode has been reported which provides stable service over a long period in an electrolyte containing an organic acid or a salt thereof. Thus, it has been difficult to carry out an electrolytic treatment of a metallic object using the liquid power feeding method with this electrolyte.

SUMMARY OF THE INVENTION

An object of this invention is to provide an excellent process for electrolytic treatment of a metallic object by the liquid power feeding method using an electrolyte containing an organic acid or salt thereof.

This invention provides a process for the electrolytic treatment of metal with an electrolyte containing an organic acid or a salt thereof, which comprises feeding power by the liquid power feeding method to an electrolytic cell and using as an anode for the liquid power feeding an insoluble anode comprising a substrate of a corrosion-resistant metal and an electrode coating based on the presence of at least some iridium oxide and formed on the substrate.

DETAILED DESCRIPTION OF THE INVENTION

This invention, by the adoption of the above-described insoluble anode as the anode for liquid feeding, enables the electrolytic treatment of a metallic object to be effectively carried out by the liquid power feeding method using as the electrolyte therefor a solution containing an organic acid or a salt thereof, for example, an ammonium salt. It, therefore, provides an extremely beneficial economic effect of enabling electrolytic treatments of metallic objects such as the formation of Al electrolytic capacitors, to be performed efficiently and easily.

The process of this invention permits effective use of known electrolytes containing various organic acids or salts thereof. Examples of organic acids usable advantageously herein include saturated monocarboxylic acids such as formic acid, acetic acid, propionic acid, and N-butyric acid; saturated dicarboxylic acids such as oxalic acid, malonic acid, succinic acid, and adipic acid; and alicyclic dicarboxylic acids such as those disclosed in Japanese patent application Laid-Open No. SHO 56(1981)-140618. The above-described electrolytes are generally prepared by adding ammonia to aqueous solutions of organic acids such as those mentioned above.

Research to find an anode which is suitable for liquid power feeding, as described above, in the electrolytic treatment of a metallic object in this electrolyte has led to a knowledge that an anode with a coating based on the presence of at least some iridium oxide meets the description satisfactorily. The present invention has resulted from this knowledge.

Pt and Pb which have found popular use as materials for anodes have high oxygen evolution potentials such that, in the electrolytes containing organic acids possessing carboxylate groups, they cause these types of organic acids to induce electrochemical reactions such as the Kolbe reaction. An anode possessing a coating based on the presence of Ru oxide and used in the electrolysis of sodium chloride, for example, possesses a relatively low hydrogen evolution potential but offers insufficient resistant to corrosion in the electrolyte contemplated by the present invention. In contrast, an anode possessing an electrode coating based on the presence of at least some Ir oxide has been demonstrated to possess an oxygen evolution potential low enough to preclude the organic acid in the electrolyte from inducing an undesired electrochemical reaction of itself, exhibits an outstanding resistance to corrosion under working conditions, and provides ample stability to withstand long term use in commercial operation.

The amount of iridium oxide in the coating is not particularly limited. However, 40 mol% or more of iridium oxide in the oxides of the oxide coatings is preferred.

The insoluble anode possessing the coating based on the presence of at least some iridium oxide is constructed by coating a substrate of a corrosion-resistant metal represented by a valve metal such as Ti, Ta, or Nb with iridium oxide used exclusively or in the form of a mixture or solid solution as combined with a platinum group metal such as Rh, an oxide of another platinum group metal, or an oxide of a nonplatinum group metal.

This invention is not limited to the anode described above specifically by the method used for manufacture thereof. The anode can be produced by the method of thermal decomposition as disclosed in Japanese patent publication No. SHO 46 (1971)-21884 (corresponding to U.S. Pat. No. 3,632,498) and Japanese patent publication No. SHO 48(1973)-3954 (corresponding to U.S. Pat. No. 3,711,385)), for example, or by any of the various methods known to the art.

In forming a composition by adding to iridium oxide another metal oxide, an oxide of Ti, Ta, Nb, Co, or Mn proves advantageous for the addition. Although the mixing ratio of such a metal oxide to iridium oxide is not specifically limited, the proportion of the metal oxide thus added preferably is not more than about 60 mol% based on the total amount of the coating metal oxide. The term "coating metal oxide" as used herein embraces a non-stoichiometric oxide and an oxide possessing lattice defects as well as a stoichiometric metal oxide. If desired, the resistance of the anode to corrosion can be enhanced by interposing, between the metal substrate and the coating oxide, an intermediate layer of the oxide of Pt, $SnO_2$, or an oxide of a valve metal.

The electrolytic treatment of a metallic object contemplated by the present invention is carried out by using the above-described insoluble anode as the anode for the liquid power feeding.

In the electrolytic oxidation of Al foil, iron or an alloy thereof is generally used as a cathode, a suspension type plate-shaped insoluble anode is used as an anode for liquid power feeding, an organic acid salt such as ammonium adipate at a concentration of about 5 to about 200 g/liter is used as an electrolyte, and the conditions of a temperature of 10° to 60° C. and a current density of 1 to 20 A/dm$^2$ are adopted.

Of course, these electrolytic conditions may be suitably varied, depending on the kind of metal subjected to treatment and the composition of the electrolyte used.

The following non-limiting example is given to illustrate further the present invention. Unless otherwise indicated herein, all parts, percents, ratios and the like are by weight.

EXAMPLE

A varying insoluble electrode was prepared by coating a Ti plate, measuring 100 mm×100 mm×1.5 mm with a metal oxide using Ir oxide as a main component. As the anode for liquid power feeding, the electrode produced was tested for performance under the above-described conditions for electrolytic oxidation of Al foil. The coating of the electrode was effected by the thermal decomposition method, i.e., by applying a hydrochloric acid solution of the chloride of the metal used for coating on the Ti substrate and heating the substrate with the deposited coating thereon in air to a temperature exceeding 400° C.

For comparison, various plate-shaped electrodes of Ti plated with Pt, Pb, Ni, and Ti plated with Pt-Ir, and Ti coated with $RuO_2$-$TiO_2$ were prepared and put to the same test.

The electrodes prepared according to this invention and those prepared for comparison were tested in an electrolytic treatment at varying current densities, using an ammonium adipate solution of a concentration of 50 g/liter, as normally used for the electrolytic oxidation of Al foil, as the electrolyte and a plate of SUS 304 as the cathode of 40° C. The results obtained are shown collectively in Table 1 below.

TABLE 1

| | Anode (mol ratio composition) | Current Density (A/dm$^2$) | Service Life of Anode (days) |
|---|---|---|---|
| Example | | | |
| 1 | $IrO_2$/Ti | 10 | 60 |
| 2 | $IrO_2$/Pt/Ti | 5 | 135 |
| 3 | $IrO_2$—$Ta_2O_5$/Ti (70:30) | 10 | 80 |
| 4 | Same as above | 5 | 213 |
| 5 | Same as above | 3 | 360 |
| 6 | $IrO_2$—$TiO_2$/Ti (60:40) | 10 | 60 |
| 7 | $IrO_2$—$MnO_2$/Ti (75:25) | 10 | 95 |
| 8 | Same as above | 5 | 180 |
| 9 | $IrO_2$—$Nb_2O_5$/Ti (65:35) | 5 | 198 |
| 10 | $IrO_2$—CoO/Ti (95:5) | 5 | 120 |
| Comparative Example | | | |
| 1 | Pt/Ti | 10 | 7 |
| 2 | Pb | 10 | 3 |
| 3 | Ni | 10 | 7 |
| 4 | Pt/Ir/Ti (70:30) | 10 | 1 |
| 5 | $RuO_2$—$TiO_2$/Ti (55:45) | 10 | 5 |

When the anodes of Comparative Examples 1–5 were used, they invariably had very short service life spans and the electroylte became colored and emitted an offensive odor due to the electrochemical reaction of adipic acid such that continued use of the anodes became impossible. In contrast, when the anodes of Examples 1–10 according to the present invention were used, they exhibited sufficiently long service life spans and enabled the electrolysis to be continued without any difficulty.

From the foregoing results, it is evident that the electrolytic treatment of a metallic object in an electrolyte containing an organic acid or a salt thereof can be carried out in a stable manner for a long time because the insoluble anode possessing the electrode coating based on the presence of at least some Ir oxide was used as the anode for liquid power feeding.

While the invention has been described in detail and with reference to specific embodiments thereof, it will be apparent to one skilled in the art that various changes and modifications can be made therein without departing from the spirit and scope thereof.

We claim:

1. A process for the electrolytic treatment of metal with an electrolyte containing adipic acid or an ammonium salt thereof, comprising feeding power indirectly through the electrolyte without contacting an anode with the metal by the liquid power feeding method and using as an anode for said liquid power feeding an insoluble anode comprising a substrate of a corrosion-resistant metal and an electrode coating consisting of 40 mol % or more of iridium oxide and 60 mol % or less of the oxide of a metal selected from the group consisting of rhodium, titanium, tantalum, niobium, cobalt, manganese and mixtures thereof and formed on said substrate.

* * * * *